US006341861B1

(12) United States Patent
Sasaki

(10) Patent No.: US 6,341,861 B1
(45) Date of Patent: Jan. 29, 2002

(54) SHEET CONVEYING APPARATUS AND IMAGE FORMING APPARATUS

(75) Inventor: Norio Sasaki, Chigasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/026,491

(22) Filed: Feb. 19, 1998

(30) Foreign Application Priority Data

Feb. 20, 1997 (JP) ..... 9-052492

(51) Int. Cl.[7] ..... B41J 2/01

(52) U.S. Cl. ..... 347/104; 101/227; 400/621; 400/625

(58) Field of Search ..... 400/625, 629, 400/621, 621.1, 120.02; 347/102, 104, 101, 43, 18, 19, 3; 101/224, 225, 226, 227

(56) References Cited

U.S. PATENT DOCUMENTS

| | | | | | |
|---|---|---|---|---|---|
| 4,192,618 | A | * | 3/1980 | Kondur et al. | 400/621 |
| 4,777,498 | A | | 10/1988 | Kasamura et al. | |
| 4,787,616 | A | | 11/1988 | Sasaki et al. | |
| 4,799,084 | A | | 1/1989 | Koike et al. | |
| 4,873,547 | A | | 10/1989 | Sasaki et al. | |
| 5,062,722 | A | * | 11/1991 | Shiozaki et al. | 400/621 |
| 5,122,841 | A | | 6/1992 | Sasaki | |
| 5,215,393 | A | * | 6/1993 | Wincent | 400/621 |
| 5,232,293 | A | * | 8/1993 | Hibon et al. | 400/621 |
| 5,323,176 | A | * | 6/1994 | Sugiura et al. | 347/102 |
| 5,343,279 | A | | 8/1994 | Nagata et al. | |
| 5,452,959 | A | * | 9/1995 | Oka | 400/621 |
| 5,484,215 | A | * | 1/1996 | Fillod et al. | 400/621 |
| 5,524,996 | A | * | 6/1996 | Carpenter et al. | 400/621 |
| 5,614,928 | A | * | 3/1997 | Matsuda | 347/102 |
| 5,651,620 | A | * | 7/1997 | Paranjpe | 400/120.02 |
| 5,764,263 | A | * | 6/1998 | Lin | 347/101 |
| 5,767,984 | A | * | 6/1998 | Momonani | 400/621 |
| 5,818,477 | A | * | 10/1998 | Fullmer et al. | 347/43 |

FOREIGN PATENT DOCUMENTS

| | | | |
|---|---|---|---|
| EP | 0 341 831 | | 11/1989 |
| EP | 0 490 512 | | 6/1992 |
| EP | 0 673 775 | | 9/1995 |
| GB | 2144296 | * | 2/1985 |
| JP | 04-73152 | | 3/1992 |

OTHER PUBLICATIONS

Patent Abstracts of Japan, vol. 017, No. 372 (P–1573), Jul. 13, 1993 & JP 05–061294 (Ricoh Co Ltd), Mar. 12, 1993.

Patent Abstracts of Japan, vol. 097, No. 002, Feb. 28, 1997 & JP 08–268652 (Sanyo Electric Co Ltd), Oct. 15, 1996.

* cited by examiner

*Primary Examiner*—Eugene Eickholt
(74) *Attorney, Agent, or Firm*—Fitzpatrick, Cella, Harper & Scinto

(57) ABSTRACT

In a conveying apparatus, a convey path is divided into a first convey path portion and a second convey path portion, a discharge tray as an escape portion for temporarily escaping a sheet conveyed in the first convey path portion and for conveying the sheet to the second convey path portion with a tail end of the sheet facing forwardly is provided between the first and second convey path portions, and there are provided nip roller and a D-cut roller as a conveying means which does not apply any load to the sheet when the sheet is being conveyed by a conveying system of an image forming means (first processing portion) and which starts to apply a conveying force to the sheet after conveyance of the sheet effected by the conveying system of the first processing portion is finished.

43 Claims, 9 Drawing Sheets

SHEET CONVEYING APPARATUS AND IMAGE FORMING APPARATUS

BACKGROUND OF THE INVENTION

1. Field of the Invention

The present invention relates to a conveying apparatus disposed between first and second processing portions having independent conveying systems, and more particularly, it relates to a sheet conveying apparatus disposed between an image forming means and a fixing means.

2. Related Background Art

As disclosed in Japanese Patent Application Laid-open No. 4-73152, there is an image forming apparatus having an image forming means as a first processing portion and a fixing means as a second processing portion.

In such an image forming apparatus, a sheet in which cationic polymer (PVA) as an ink holding layer is coated on a RET (polyethylene terephthalate) film as a substrate and a white ink transporting layer is coated on the ink holding layer is used as a recording material. The ink transporting layer is obtained by mixing activator and polyethylene particles by using ionomer as binder.

An image is recorded by an ink jet recording head (image forming means) of line type covering the entire width of the recording material, and the ink transporting layer is melted by a pair of pressure/heat rollers (fixing means) disposed adjacent to and at a downstream side of the recording head to make the transporting layer smooth and transparent, thereby forming a transparent smooth layer coating the imaged surface of the recording material.

In the above-mentioned image forming apparatus, since image accuracy is greatly influenced by conveying accuracy of the image forming means, it is desirable that the image forming means is not subjected to a force from a conveying system of the fixing means as less as possible.

When a distance between the processing portions is selected to become greater than a length of a maximum sheet to be treated, since the sheet is conveyed to the second processing portion after it leaves the first processing portion, the interference between the processing portions can be prevented.

However, if a sheet to be treated has a considerably great length, the entire apparatus including the sheet conveying apparatus becomes bulky accordingly.

SUMMARY OF THE INVENTION

The present invention aims to eliminate the above-mentioned conventional drawback, and an object of the present invention is to provide a compact conveying apparatus which is disposed between the processing portions and which can cope with recording materials having various sizes without interference between conveying systems of the two processing portions.

To achieve the above object, according to the present invention, there is provided a conveying apparatus disposed between first and second processing portions having independent conveying systems and including a convey path for feeding a processed medium conveyed from the first processing portion to the second processing portion, in which the convey path is divided into first and second convey path portions, and an escape portion for temporarily escaping the processed medium conveyed in the first convey path portion and for conveying the processed medium to the second convey path portion with a tail end of the processed medium facing forwardly is provided between the first and second convey path portions, and there is provided a conveying means which does not apply any load to the processed medium when the processed medium is being conveyed by the conveying system of the first processing portion and starts to apply a conveying force to the processed medium after the conveyance of the processed medium effected by the conveying system of the first processing portion is finished.

In the specification, "processing" means the fact that the processed medium (sheet) is subjected to various phenomena for changing quality of the sheet. The "sheet" means all of sheet-shaped processed media, as well as a cut sheet and an OHP sheet.

With the arrangement as mentioned above, when the conveyance in the first processing portion is finished, the conveying means starts to convey the processed medium in a direction along which the tip end of the processed medium is escaped. After the processed medium is conveyed until the tail end of the processed medium reaches the vicinity of the escape portion, the conveying means is rotated reversely so that the processed medium starts to be conveyed toward the second convey path portion with the tail end of the processed medium facing forwardly.

The conveying means may be provided at the escape portion.

It is preferable that the convey path is bent around the escape portion.

It is preferable that the conveying means comprises a roller shiftable in an up-and-down direction.

The conveying means may comprise a D-cut roller.

The D-cut roller is a roller in which a part of periphery of a roller is cut away.

There may be provided a shutter for directing the tail end of the processed medium conveyed from the first convey path portion to the second convey path portion.

The convey means may comprise a vertically shiftable roller provided in the first convey path portion, a D-cut roller provided at the escape portion, first and second sheet (processed medium) detecting means provided in the first convey path portion, and convey rollers provided in the second convey path portion and may be designed so that the above elements are disposed to satisfy a relation "$L3<L1<L2<L$" when a length of an arc of the D-cut roller is L, a distance from a nip point of the vertically shiftable roller to the D-cut roller is L1, a distance from the first sheet detecting means to the D-cut roller is L2 and a distance from the D-cut roller to an most upstream convey roller (among the convey rollers) is L3, and the second sheet detecting means is disposed immediately in front of the escape portion.

It is preferable that, in a sheet conveying apparatus, the processed medium treated by the above-mentioned conveying apparatus is a sheet and the first processing portion is an image forming means.

As mentioned above, the "sheet" means all of sheet-shaped processed media, as well as a cut sheet and an OHP sheet.

The second processing portion may be a fixing means.

At least one roller having a driving force may be disposed in the second convey path portion between the escape portion and the fixing means, and such a roller may be a one-way roller driven by a conveying force of the fixing means not to generate slip between the sheet and the roller.

A plurality of rollers may be provided in the second convey path portion, and, by a conveying force of a most downstream roller among the rollers contacted with the sheet, the other rollers may be rotatingly driven.

A temperature of a surface of the sheet may be increased before the fixing by fixing heat generated by the fixing means.

The present invention further provides an image forming apparatus comprising the above-mentioned sheet conveying apparatus, an image forming means as the first processing portion, and a fixing means as the second processing portion.

The present invention also provides an image forming apparatus for forming an image on a processed medium obtained by coating ink permeable polymer film on a substrate, wherein, after the image is formed on the processed medium by the image forming means in an ink jet manner, the processed medium is thermally treated by the fixing means to make the polymer film finer.

DETAILED DESCRIPTION OF THE PREFERRED EMBODIMENTS

The present invention will now be explained in connection with embodiments thereof with reference to the accompanying drawings. However, dimensions, materials, configurations and relative positions of constructural elements described in the embodiments do not limit the present invention, except for special mention.

First Embodiment

An arrangement in which a sheet conveying apparatus according to a first embodiment of the present invention is applied to an image forming apparatus is shown in FIGS. 1 to 9.

Figure 6:
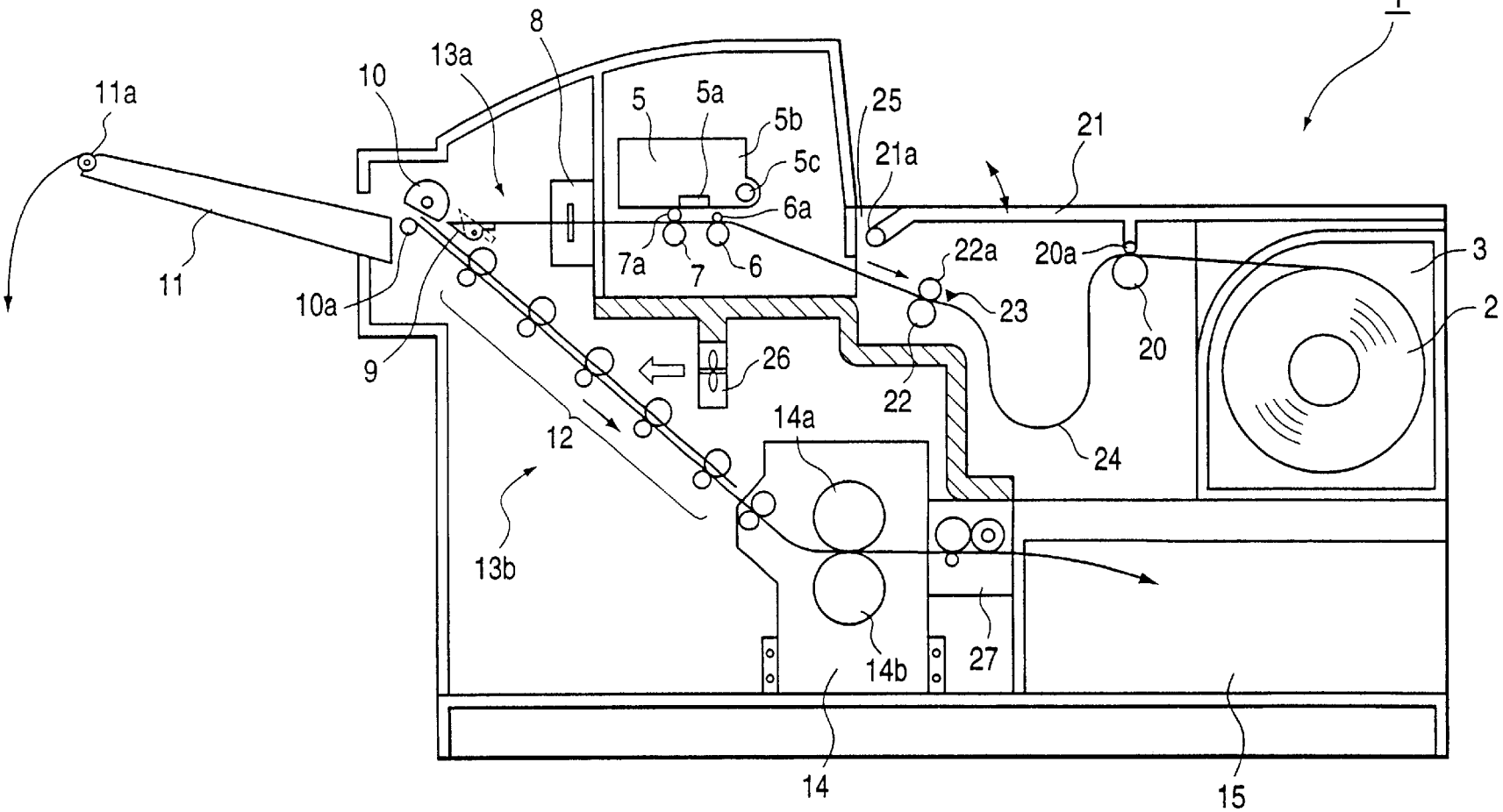
FIG. 6 is a sectional view of an image forming apparatus to which the sheet conveying apparatus according to the first embodiment is applied.
Figure 7:
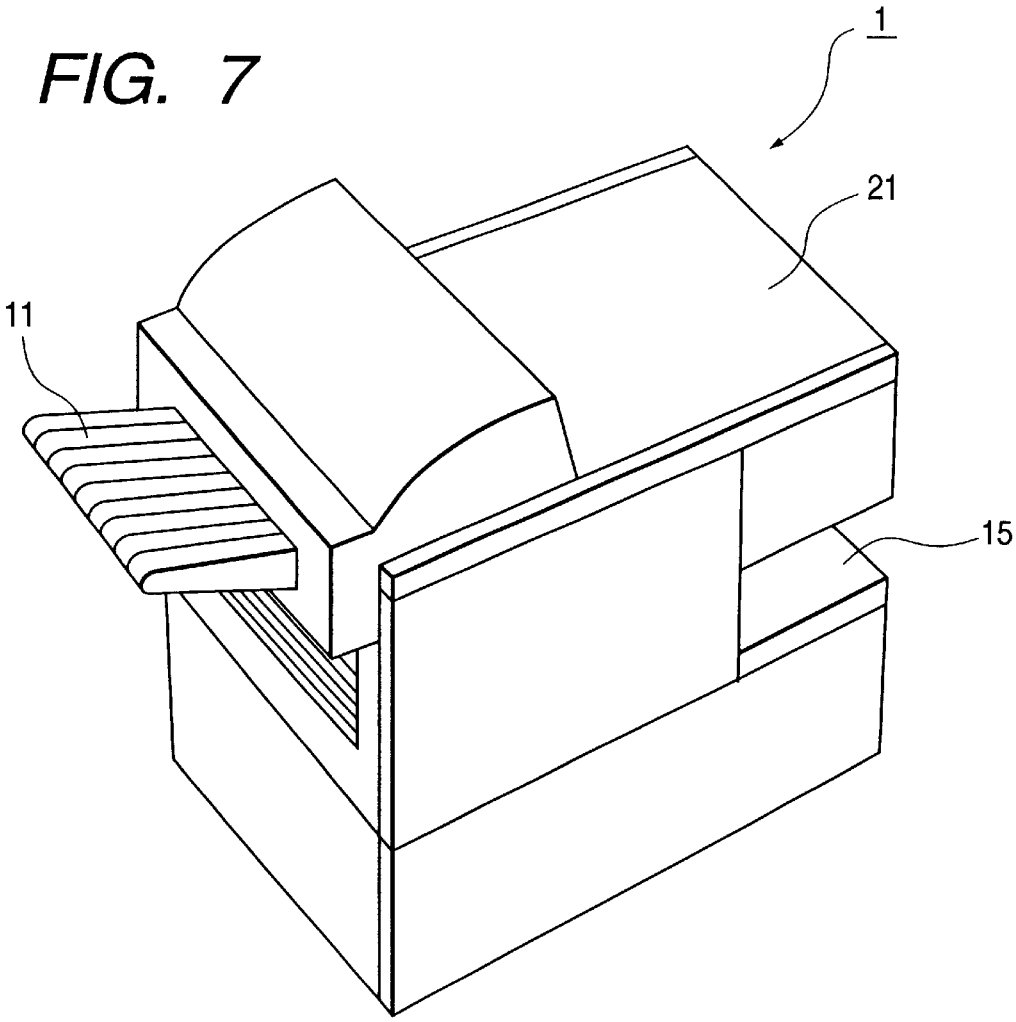
FIG. 7 is a perspective view of the image forming apparatus of FIG. 6.
Figure 8:
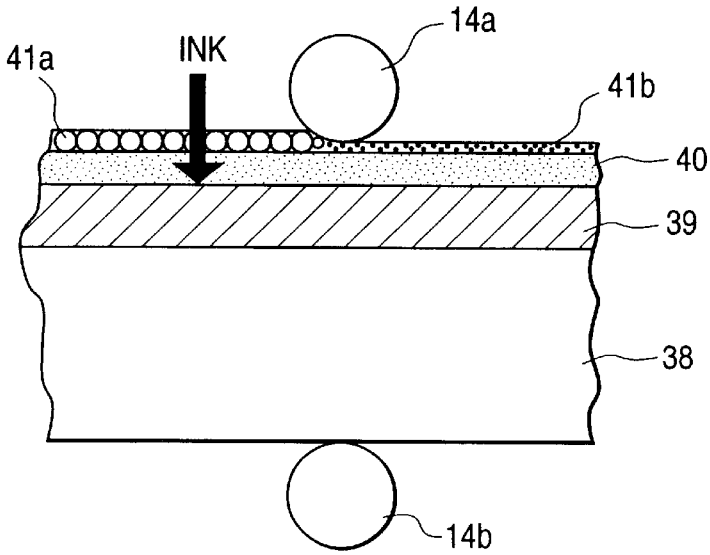
FIG. 8 is a sectional view of a sheet used in the sheet conveying apparatus according to the first embodiment.
Figure 9:
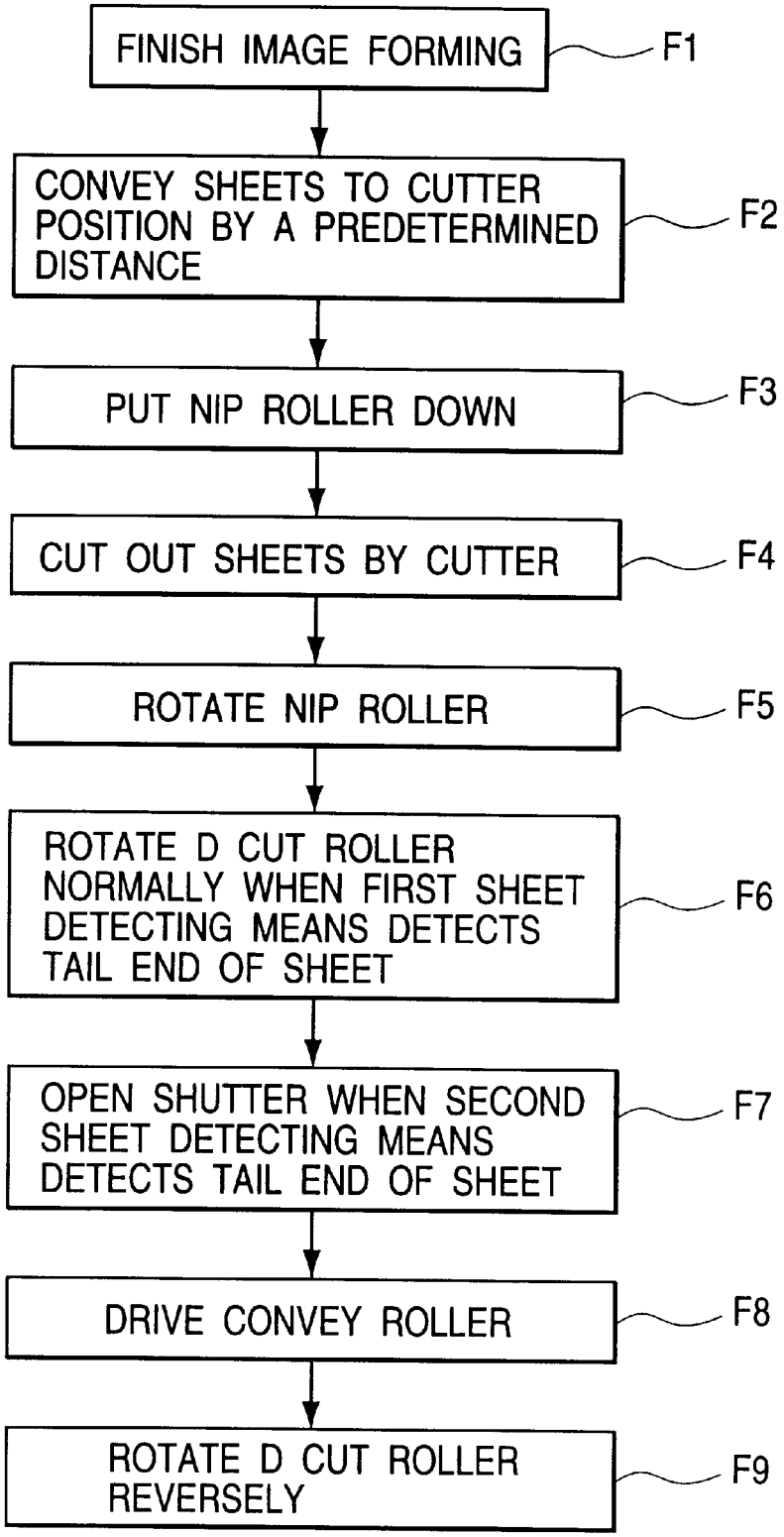
FIG. 9 is a flow chart showing an operation sequence of the sheet conveying apparatus according to the first embodiment.

Among these Figures, FIGS. 1 to 5 are enlarged views for explaining an operation of the sheet conveying apparatus, FIG. 6 is a sectional view of the image forming apparatus, FIG. 7 is a perspective view of the image forming apparatus, FIG. 8 is a sectional view of a sheet used in the sheet conveying apparatus, and FIG. 9 is a flow chart showing an operation sequence of the sheet conveying apparatus.

Construction of Sheet

Since the image forming apparatus according to the first embodiment mainly treats special media and has various features corresponding to features of the media (sheets), a construction of the sheet will firstly be described.

FIG. 8 shows the sheet pinched between fixing rollers. As shown in FIG. 8, the sheet is constituted by four layers, i.e., a latex layer (ink permeable polymer film) 41*a*, a coloring layer 40 mainly absorbing ink, a substrate 39 formed from a RET (polyethylene terephthalate) sheet or a baryta sheet, and a back coating 38.

As shown, the latex layer 41*a* having the noticeable feature is melted by heat (110–180° C.) of a fixing roller 14*a* and is changed to a transparent laminated layer 41*b* after cooling. As a result, gloss, water-resistance and anti-weather of an image are greatly improved.

Entire Construction of Apparatus

In FIGS. 6 and 7 showing the entire apparatus, an image forming apparatus 1 comprises a sheet supplying system, an image forming system as a first processing portion, a conveying system (switch-back conveying system) as a convey path or a convey means including an escape portion, and a fixing system as a second processing portion. The image forming system and the fixing system are disposed side by side in a vertical direction so that sheet convey path portions are disposed side by side in a vertical direction.

The sheet supplying system includes an upper lid 21 which can be opened and closed around a hinge 21*a* so that a cartridge 3 containing a roll-shaped sheet 2 can be incorporated into the sheet supplying system, a pair of pick-up rollers 20, 20*a* for drawing the sheet from the cartridge 3, and a pair of pulling rollers 22, 22*a* for sending the sheet to the image forming system. A loop having a substantially constant amount is formed in the sheet between the pair of pick-up rollers 20, 20*a* and the pair of pulling rollers 22, 22*a*. A nip between the paired pulling rollers 22 and 22*a* can be released by a cam (not shown).

The image forming system as the first processing portion mainly includes an image forming portion 5 of ink jet type, a line feed roller (LF roller) 6 which is a conveying system as a second conveying means for effecting conveyance of the sheet during image formation, an LF driven roller 6*a*, a spurred roller 7*a*, and a downstream LF roller 7 so that the sheet conveyed from the sheet supplying system can be conveyed intermittently by a predetermined length Li (about 10 mm). The image forming system is constituted by the image forming portion 5, LF roller 6, LF driven roller 6*a*, downstream LF roller 7 and spurred roller 7*a*. Further, a sheet insertion opening 25 and an open/close switch (not shown) for the sheet insertion opening are provided to permit a sheet manual insertion.

A cutter 8 for cutting the sheet to a desired length is disposed between the image forming system and the switch-back conveying system.

The switch-back conveying system comprises a sheet conveying apparatus for conveying the sheet between the image forming system and the fixing system which are not synchronous with each other mechanically and are not interfered with each other. Further, there are provided a shutter 9, a D-cut roller 10 as a conveying means, and a plurality of pairs of convey rollers 12 disposed along a conveying direction. The convey path is divided into a first convey path portion 13*a* and a second convey path portion 13*b* before and after the D-cut roller 10. An escape portion 11*b* is provided so that the sheet conveyed through the first convey path portion is temporarily escaped from the convey path to a discharge tray 11 as a guide without fail, and the entire convey path is bent at the escape portion 11*b*.

Lower rollers of the plural pairs of rollers 12 are rotatably mounted on an open/close door (not shown) so that a jammed sheet can easily be removed.

The fixing system includes a heating means or fixing means 14 comprised of a pair of fixing rollers including a heat roller 14*a* and a pressure roller 14*b*.

Operation of Apparatus

When a new cartridge 3 is loaded, in a condition that the upper lid 21 is opened, the sheet is drawn from the cartridge 3 and a tip end of the sheet is inserted into a nip of the pair of pulling rollers 22, 22*a*. A sensor 23 detects the tip end of the sheet to rotate the pulling roller 22. Thereafter, when the upper lid 21 is closed, the pair of pick-up rollers 20, 20*a* start to rotate, thereby forming the loop 24 in the sheet between the pair of pick-up rollers 20, 20*a* and the pair of pulling rollers 22, 22*a*. When the tip end of the sheet supplied from the pair of pulling rollers 22, 22*a* reaches the image forming means and is pinched by a nip between the LF roller 6 and the LF driven roller 6*a* and a nip between the downstream LF roller 7 and the spurred roller 7*a*, the nip of the pair of pulling rollers 22, 22*a* is released by the cam (not shown).

Since image forming accuracy is greatly influenced upon conveying accuracy of the LF roller 6 and the downstream LF roller 7, by forming the loop and by releasing the nip in this way, while the sheet is being conveyed in the image forming system, the sheet is not subjected to any load from other conveying members.

Accordingly, the loop 24 must be maintained during the image formation. To this end, there is provided a look sensor (not shown) associated with the pair of pick-up rollers 20, 20*a*.

The image forming portion 5 serves to convey the sheet pinched between a platen (not shown) and a sheet hold-down member (not shown) intermittently in the conveying direction by the predetermined length (about 10 mm). The image forming portion 5 utilizes cyan color ink, light cyan color ink, magenta color ink, light magenta color ink, yellow color ink and black color ink to achieve high quality image formation.

That is to say, the image forming portion 5 includes a recording head 5*a* having six kinds of nozzles for discharging the cyan color ink, light cyan color ink, magenta color ink, light magenta color ink, yellow color ink and black color ink. A carriage 5*b* on which the recording head 5*a* is mounted is shifted along a carriage guide 5*c* in a direction perpendicular to the sheet conveying direction (scanning) and ink is discharged from the recording head 5*a* integrally shifted together with the carriage 5*b* in response to image data, thereby forming an image. The carriage 5*b* is shifted by a drive means (not shown). The carriage 5*b* and the drive means constitute a shift means.

Whenever one scan is effected, an image is formed on an area having a predetermined length Li in the conveying direction (recording width) through the entire width of the sheet. Whenever the image formation by one scan is finished, the sheet is conveyed by the LF roller 6 and the downstream LF roller 7 by a distance same as the predetermined length Li and then is stopped. After the sheet is stopped, next scan is effected to form an image on a next similar area.

By repeating the image formation on the recording width Li effected by the recording head 5*a* and the conveyance of the sheet by the recording width Li effected by the LF roller 6 and the downstream LF roller 7 alternately, the entire image continuous in the conveying direction is formed on the sheet.

A nip roller 16 provided in the first convey path portion 13*a* is supported on a free end of an arm 16*c* rockable around a shaft 16*b*.

During the image formation, the nip roller 16 provided in the first convey path portion 13*a* is spaced apart from a driving roller 16*a* so that the sheet is not pinched between these rollers. Further, the D-cut roller is normally positioned so that a cut-out portion 10*c* (of the D-cut roller) having a smaller radius is opposed to a driven roller 10*a* not to pinch the sheet therebetween. The reason is that any conveying load is not applied to the sheet during the image formation to improve the conveying accuracy of the LF roller 6 and the downstream LF roller 7.

As the image formation is continued, when the image having a predetermined length or more is formed, the tip end of the sheet is directed onto the discharge tray 11.

When the image formation is finished, the sheet is conveyed by the conveying system of the image forming system until a portion of the sheet to be a tail end after cutting reaches the position of the cutter 8 to obtain a cut sheet having a desired length. After the sheet is pinched by the switch-back conveying systems so that the sheet is not dropped out of the apparatus, the sheet is cut by the cutter 8.

After the sheet having the desired length is transferred to the switch-back conveying system in this way, the remaining sheet portion is returned to a position where the tip end of the sheet is positioned at the image formation start position, thereby preparing for next image formation.

Regarding the sheet transferred to the switch-back conveying system, after the sheet is escaped until the tail end thereof reaches a position immediately below the D-cut roller 10, the shutter (guide means) 9 is switched and the D-cut roller 10 is rotated reversely. Although the tail end of the sheet is conveyed toward the image forming portion, due to the presence of the switched shutter 9, the sheet is directed to the second convey path portion 13*b*. In the second convey path portion, the plurality of pair of convey rollers 12 are disposed side by side and are rotated at the same speeds so that the sheet is conveyed with the tail end thereof facing forwardly. Each of these paired convey rollers is constituted by a one-way roller so that, if the pairs of convey rollers 12 are rotated at different speeds for some reason, the rotational speed of the convey rollers is changed to become the same as that of a most downstream pair of convey rollers among the pairs of convey rollers contacted with the sheet and the other convey rollers are rotatingly driven in synchronous with the most downstream pair of convey rollers. Accordingly, any load is not applied to the sheet and no slip is generated between the sheet and the rollers. Lower rollers of the plural pairs of convey rollers 12 are biased by springs (not shown) toward the corresponding lower rollers to adjust nips between the upper rollers and the lower rollers, thereby preventing the latex layer of the sheet from being damaged.

The sheet passed through the second convey path portion is transferred to the fixing system. At the same time, the driving of the pairs of convey rollers 12 is stopped so that these rollers are rotatingly driven by the conveying force of the fixing rollers 14*a* , 14*b*. The latex layer formed on the surface of the sheet is melted by the heat (110–180° C.) of the fixing roller. After cooled, the latex layer becomes a transparent laminated layer (FIG. 8). Further, the heat generated in the fixing system is transmitted to the sheet existed in the second convey path portion 13*b* by means of a fan 26, thereby achieving the pre-heat effect.

A curl formed in the sheet left the fixing system is corrected by an uncurling means or curl correcting means 27 and then is discharged to a discharge portion 15.

Construction and Operation of Switch-back Conveying System

Next, the switch-back conveying system which is the most important characteristic of the present invention will be explained with reference to FIGS. 1 to 5 and FIG. 9.

The switch-back conveying system is a sheet conveying apparatus in which the sheet conveyed from the image forming means is switched back to convey it to the fixing means and which comprises the shutter 9, D-cut roller 10, discharge tray 11, convey rollers 12, vertically shiftable nip roller 16, first sheet detecting means 30 and second sheet detecting means 31. The reference numeral 12a denotes a most upstream convey roller (nearest to the D-cut roller) among the convey rollers 12.

Now, the operation of this sheet conveying apparatus will be described with reference to an operation sequence shown in FIG. 9.

A control means (not shown) controls the cutter 8, a drive means such as a motor and a clutch for shifting the nip roller 16 in the vertical direction, a drive means such as a motor and a clutch for rotating the driving roller 16*a*, a drive means such as a motor and a clutch for rotating the D-cut roller 10, and a solenoid for shifting the shutter 9. The control means also controls motors for driving the LF roller 6 and the downstream LF roller 7, a drive means for shifting the carriage 5*b* and a drive means for discharging the ink from the recording head 5*a*.

Figure 1:
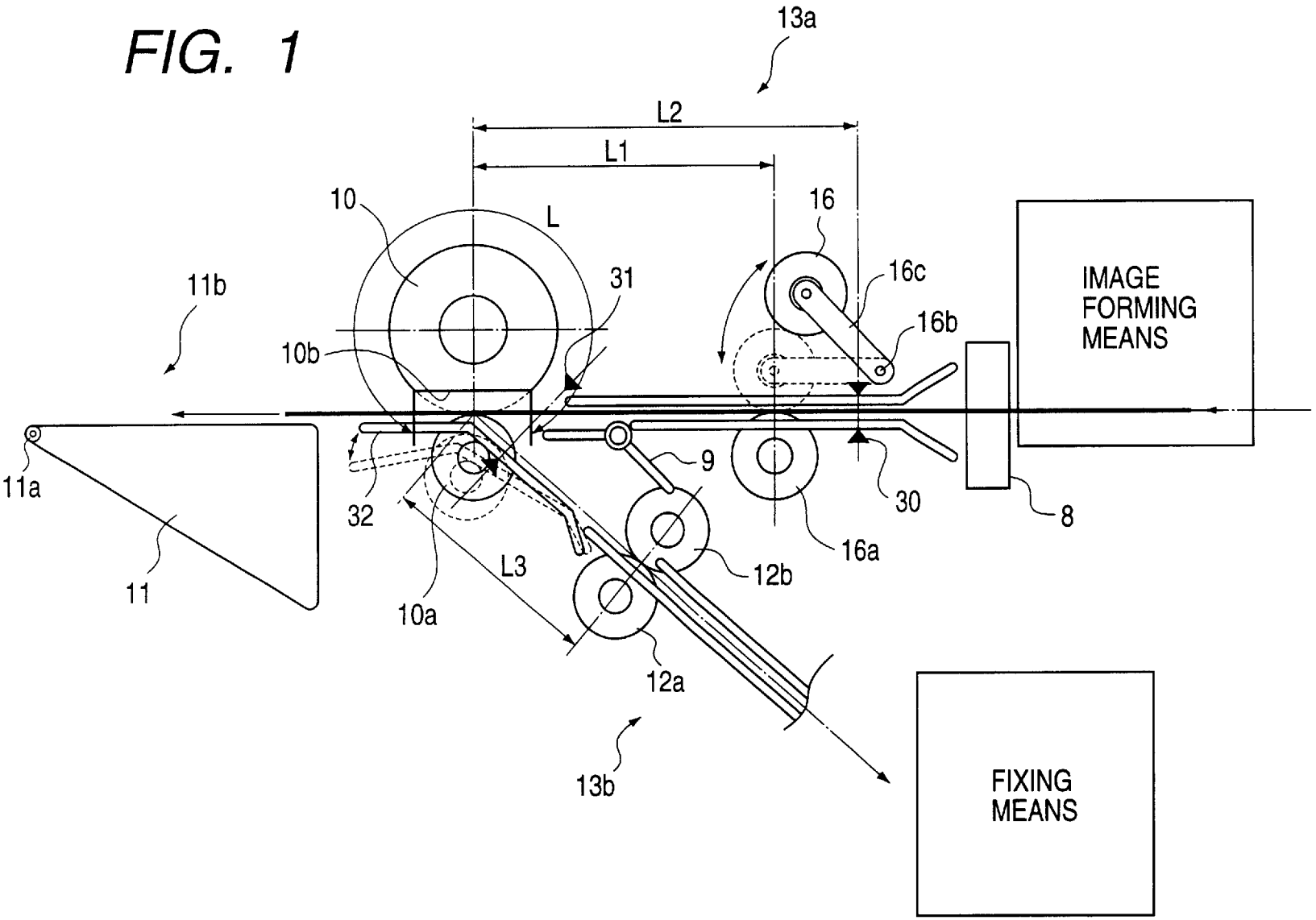
FIGS. 1, 2, 3, 4 and 5 are enlarged views for explaining an operation of a sheet conveying apparatus according to a first embodiment of the present invention.
Figure 2:
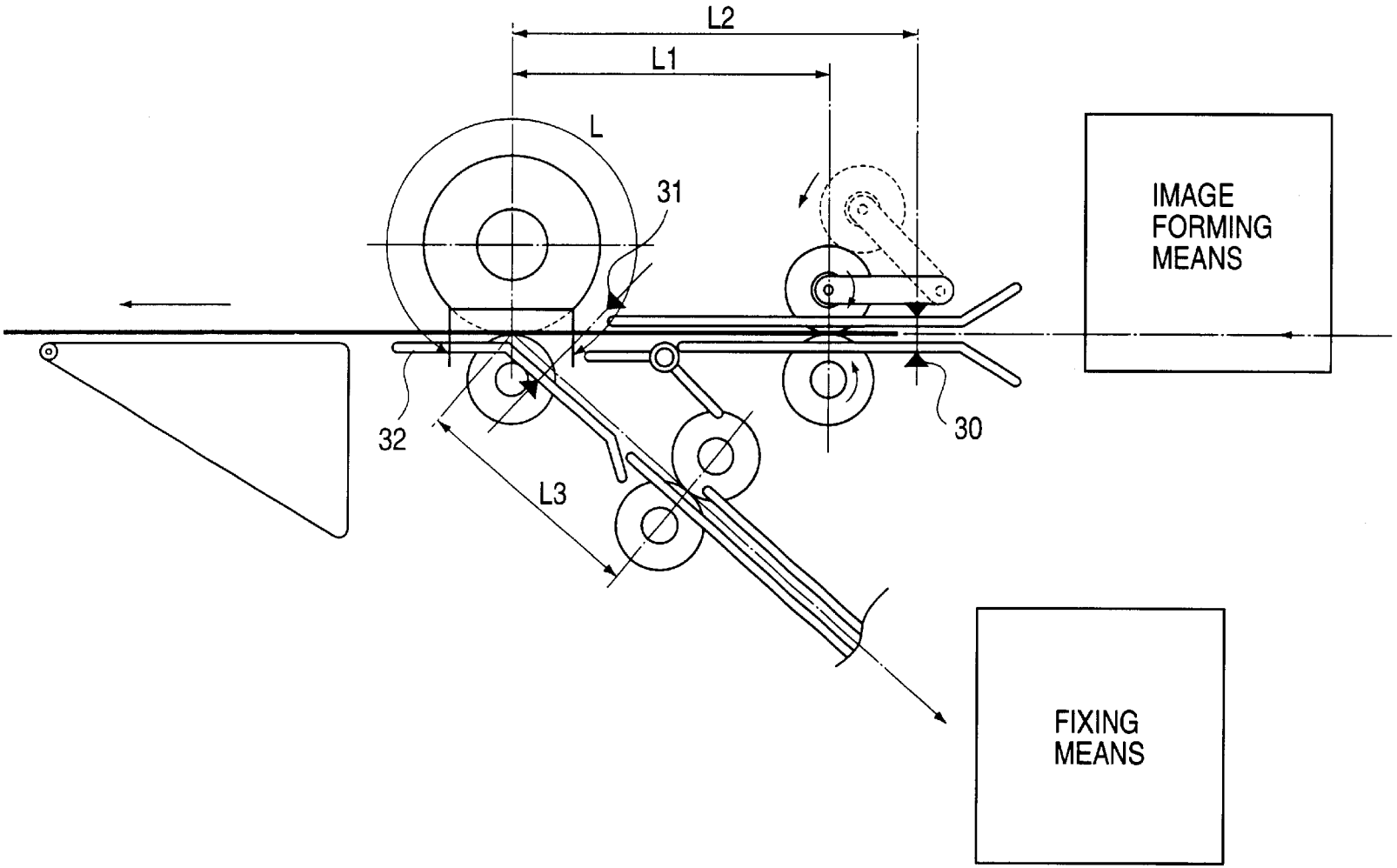
Figure 3:
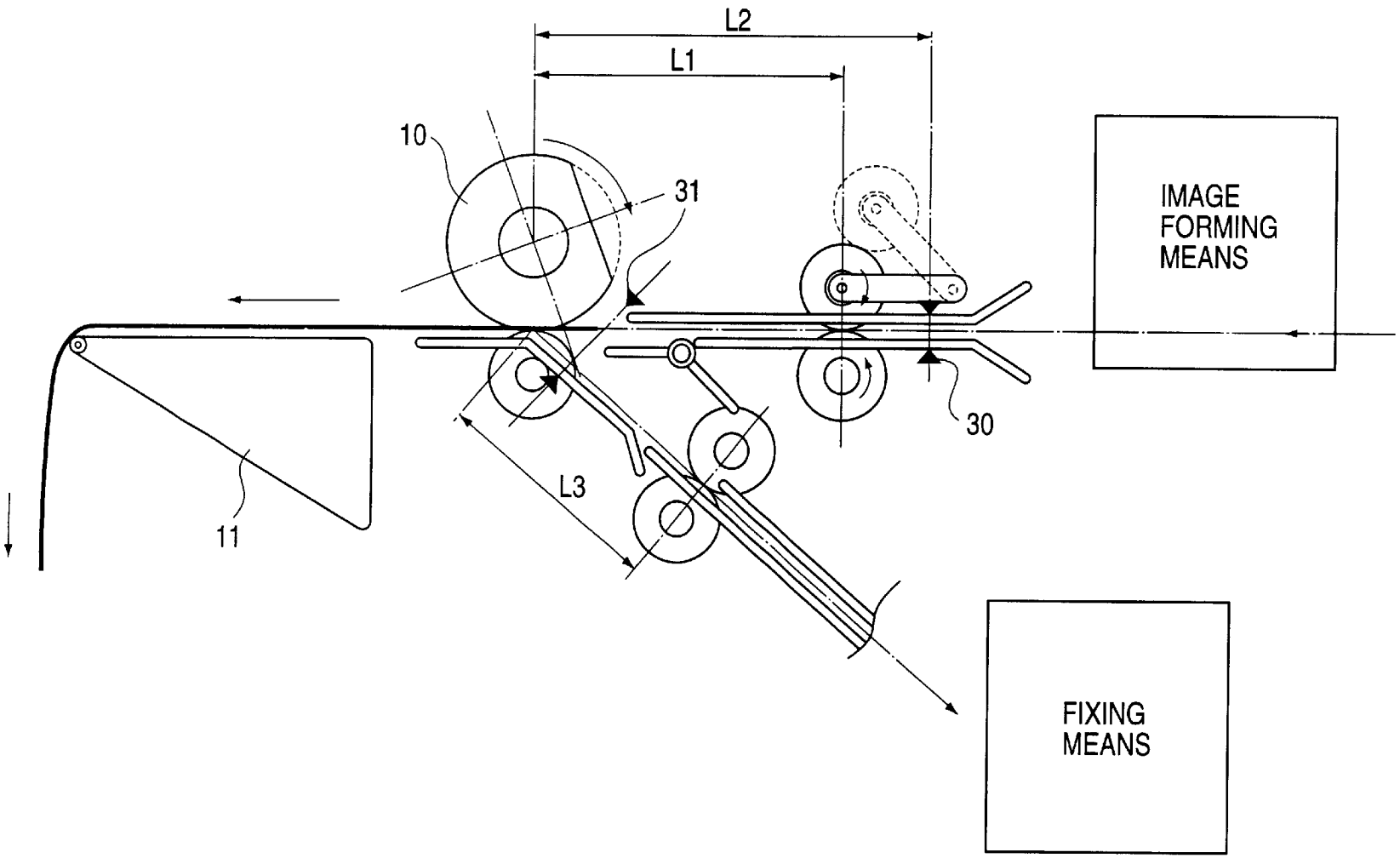
Figure 4:
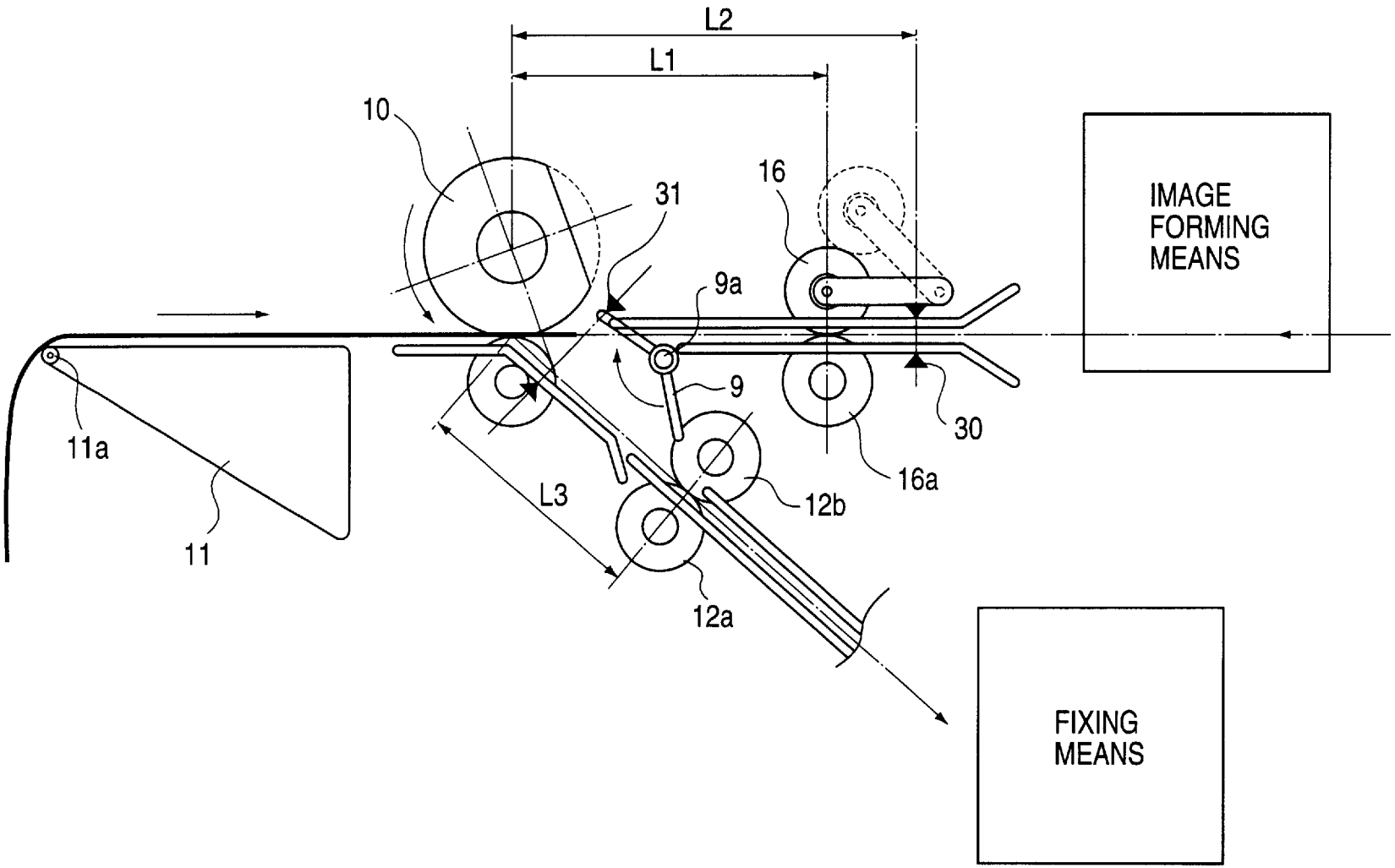
Figure 5:
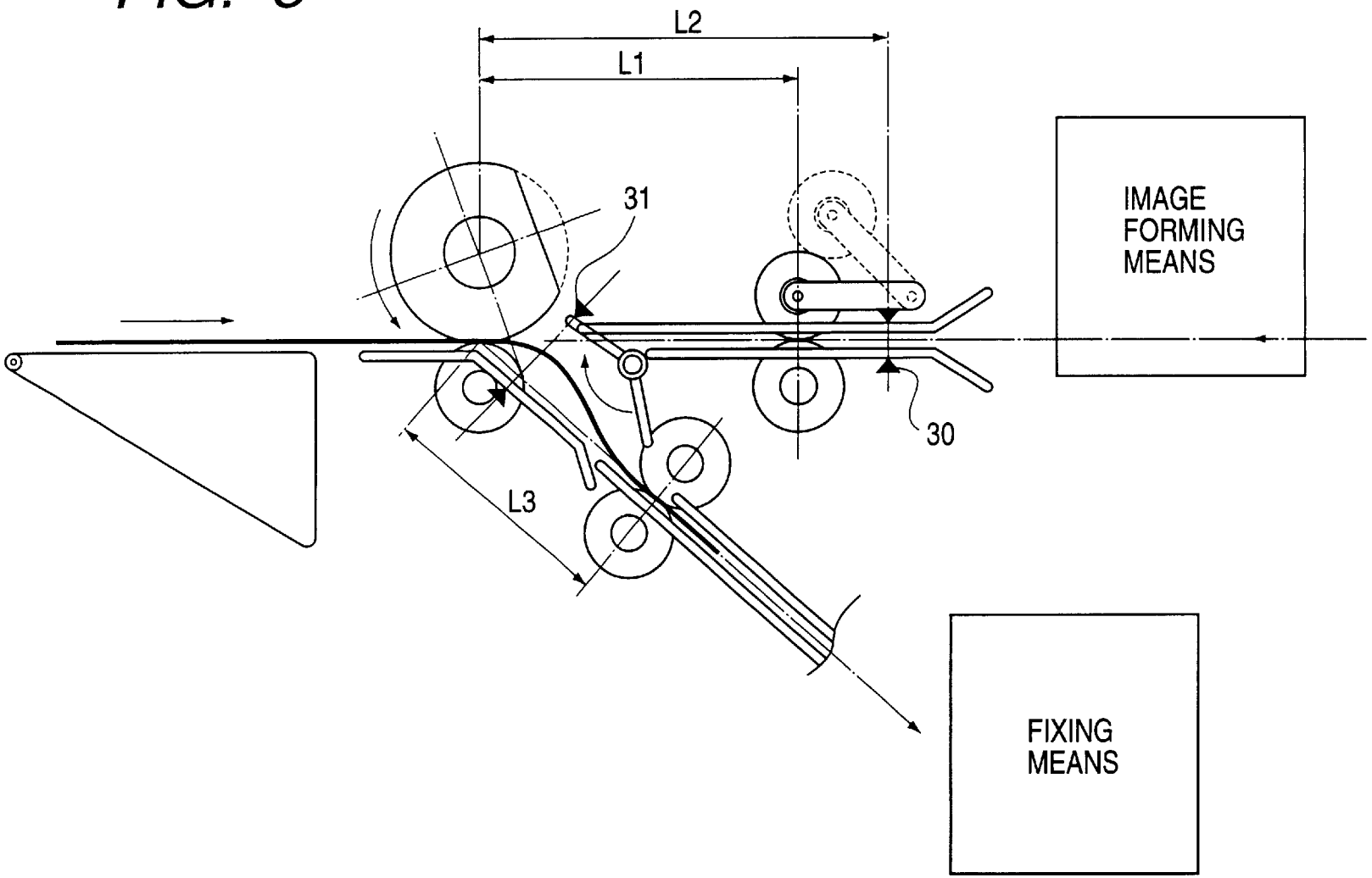

During the image formation, the sheet conveying apparatus is firstly positioned in a condition shown in FIG. 1. That is to say, the nip roller 16 is waiting at the upper position to be spaced apart from the driving roller 16*a*, with the result that the sheet is not pinched between the rollers 16 and 16*a*. Further, the cut-out portion 10*c* of the D-cut roller 10 having the small radius is opposed to the driven roller 10*a* so that the sheet is not pinched between the rollers 10 and 10*a*. The portion of the sheet on which the image was formed is conveyed toward the discharge tray 11 by the LF roller 6 and the downstream LF roller 7 without applying any load from the rollers 16, 16*a*, 10, 10*a* to the sheet portion. In this case, the guide 32 disposed below the D-cut roller 10 is lowered together with the driven roller 10*a* by the cam (not shown) to be brought to a position shown by the broken line in FIG. 1, thereby providing, below the D-cut roller 10, an adequate space through which the sheet is discharged onto the discharge tray 11.

When the image formation is finished (flow F1), the sheet is conveyed by the LF roller 6 and the downstream LF roller 7 to the position where the portion of the sheet to be cut is positioned at the cutting position of the cutter 8 so that the sheet can be cut to the desired length (flow F2).

When the sheet is conveyed to the cutting position, the arm 16*c* is rocked downwardly, so that the sheet is pinched between the nip roller 16 and the driving roller 16*a* (flow F3), and, the sheet is cut by the cutter 8 (flow F4).

When the size of the sheet is large, at this point, the tip end of the sheet is suspended from the discharge tray 11. The reason why the sheet is pinched between the nip roller 16 and the driven roller 16*a* before the sheet is cut by the cutter 8 is that the sheet is prevented from dropping from the discharge tray by the weight of the sheet itself upon cutting the sheet. Although the sheet can be pinched between the D-cut roller 10 and the driven roller 10*a* for preventing the sheet from being dropped, due to the design limitation, since a distance between the cutter 8 and the D-cut roller 10 should be longer than a smallest length (for a post card) of the sheet, in the illustrated embodiment, the nip roller 16 is provided to convey such a sheet to the D-cut roller 10.

Incidentally, a roller 11*a* or member having an arch-like curvature is provided at a tip end of the discharge tray to improve the sliding effect of the sheet on the discharge tray.

When the sheet is cut by the cutter 8, the driving roller 16*a* starts to be rotate to convey the sheet in a first direction (flow F5). Thereafter, when the tail end of the sheet is detected by the first sheet detecting means 30 (flow F6), the D-cut roller starts to rotate normally (in a clockwise direction in FIG. 2). At the same time when the rotation of the D-cut roller 10 is started, the guide 32 is shifted upwardly to the position shown by the solid line to form the nip between the D-cut roller 10 and the driven roller 10*a* of the guide 32.

When the tail end of the sheet is detected by the second sheet detecting means 31 (FIG. 3) (flow F7), the shutter 9 is switched by rotating it in a clockwise direction around the shaft 9*a* (flow F7), and, at the same time, the convey rollers 12 start to rotate (flow F8) to rotate the D-cut roller 10 reversely while pinching the sheet (FIG. 4) (flow F9).

The tail end of the sheet is directed, by the shutter 9, to the most upstream convey roller 12*a* among the convey rollers 12, with the result that the sheet is conveyed toward the fixing means by the convey rollers.

In order to effect such conveyance of the sheet, the arrangement of various elements or members is predetermined.

More specifically, when it is assumed that a length of an arc of the D-cut roller 10 is L, a distance from a nip point of the nip roller 16 to the D-cut roller 10 is L1, a distance from the first sheet detecting means 30 to the D-cut roller 10 is L2 and a distance from the D-cut roller 10 to the convey rollers 12*a* is L3, the elements must be arranged to satisfy a relation "$L3<L1<L2<L$".

As mentioned above, since the sheet is once escaped, in dependence upon the size of the discharge tray, the image formation can be effected regarding the sheet having greater length.

Second Embodiment

Figure 10:
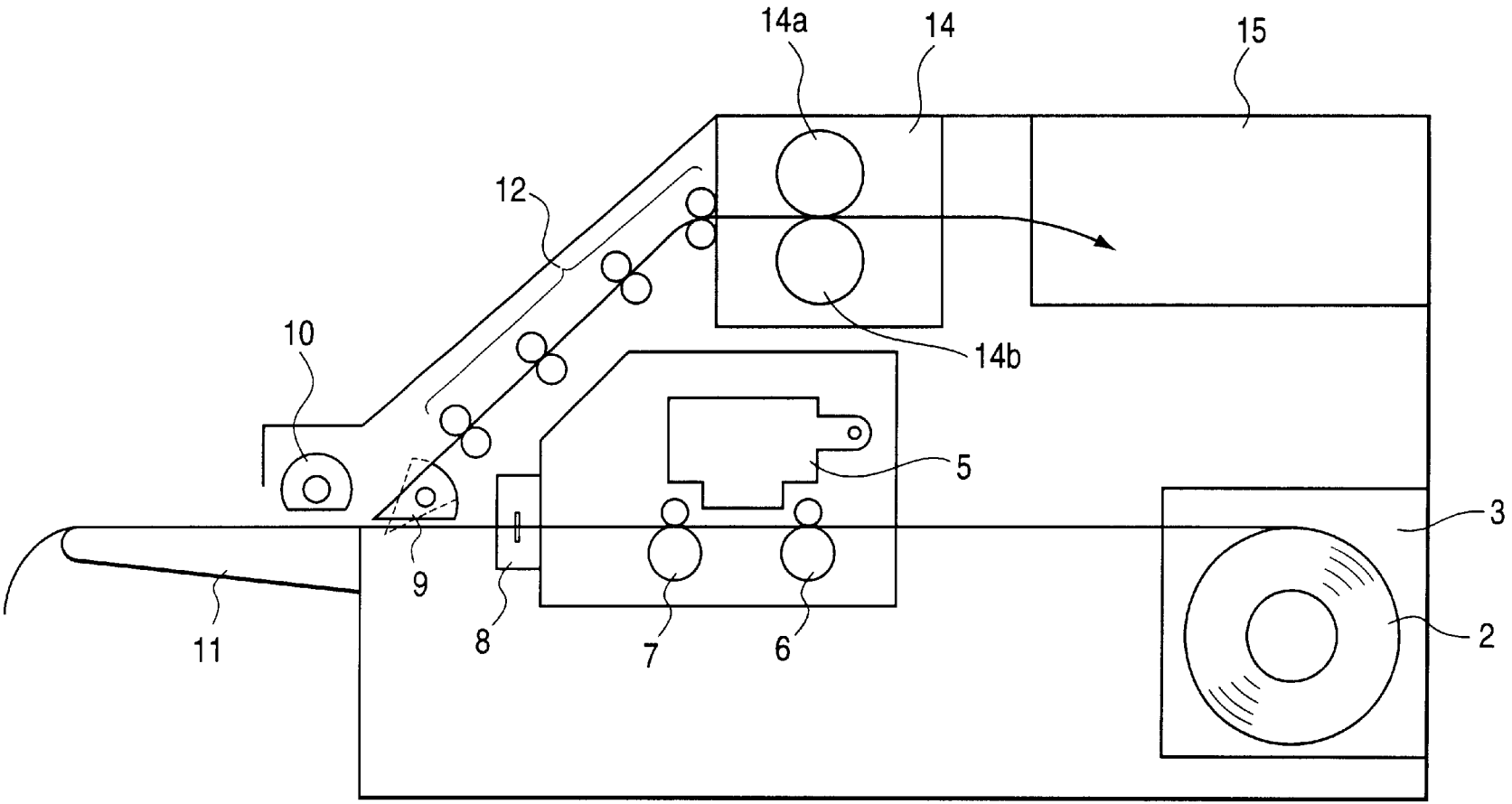
FIG. 10 is a sectional view of an image forming apparatus to which the sheet conveying apparatus according to a second embodiment of the present invention is applied.

FIG. 10 shows a case where a sheet conveying apparatus according to a second embodiment of the present invention is applied to an image forming apparatus.

While an example that the second convey path portion 13*b* is disposed below the first convey path portion 13*a* was explained in the first embodiment, in the second embodiment, the second convey path portion is disposed above the first convey path portion 13*a*. Since the other functions and effects are the same as those in the first embodiment, the same elements are designated by the same reference numerals and explanation thereof will be omitted.

Other Embodiments

In the above-mentioned embodiment, while an example that the sheet conveying apparatus according to the present invention is applied to the image forming apparatus was explained, the sheet conveying apparatus can be applied to any apparatuses so long as the sheet conveying apparatus is disposed between two processing portions having independent conveying systems.

Further, while an example that the D-cut roller is used as the conveying means of the escape portion was explained, in place of the D-cut roller, a vertically shiftable nip roller may be used.

As the first and second sheet detecting means, sensors of light permeable type may be used or mechanical sensors may be used. When the mechanical sensor is used as the second sheet detecting means, it is desirable that the operation of the sensor does not interfere with the shutter, and, it is preferable that such a mechanical sensor is provided integrally with the shutter 9.

After the image formation, it is important that an adequate waiting time during which the image formed on the sheet is absorbed to the sheet is provided before the sheet conveyed by the nip roller, so that the image (ink) can be prevented from being transferred onto the nip roller. In this case, it is preferable that the waiting time is controlled on the basis of material of the sheet and/or an amount of ink used in the image formation. By doing this, the adequate waiting time during which the image formed on the sheet is absorbed to the sheet can be set, thereby improving the image quality and shortening the image forming time.

The D-cut roller may be disposed nearer to the discharge roller, and two or more nip rollers 16 may be provided.

The present invention provides the sheet conveying apparatus disposed between the first and second processing portions having the independent convey systems and including the convey path for feeding the processed medium conveyed from the first processing portion to the second processing portion, and wherein the convey path includes the first convey path portion, second convey path portion, and escape portion for temporarily escaping the processed medium from the first convey path portion and for conveying the processed medium to the second convey path portion with the tail end of the processed medium facing forwardly, and further wherein the convey path is provided with the convey means in which any load is not applied to the processed medium during the conveyance of the processed medium in the first processing portion and thereafter the conveying force is applied to the processed medium. With this arrangement, the processed media having various sizes can be conveyed without making the apparatus bulky and preventing the interference between the two processing portions.

In the above-mentioned embodiment, while an example that the present invention is applied to the image forming apparatus was explained, the present invention is not limited to such an example, but, may be applied to any sheet processing apparatus in which treatment is effected in first and second processing portions.

In this case, when sheet conveying speed, sheet conveying sequence and/or sheet conveying method of the first processing portion differ from those of the second processing portion, the advantages of the present invention can be achieved more effectively.

Further, the ink permeable layer may be formed from a porous polymer layer (particularly, a resin porous layer). By effecting heat treatment regarding such a layer, a transparent polymer (resin) layer is formed on the imaged surface of the sheet.

What is claimed is:

1. A conveying apparatus disposed between a first processing portion and a second processing portion each having an independent conveying system, and including a convey path for feeding a processed medium conveyed from said first processing portion to said second processing portion, wherein said convey path is divided into a first convey path portion and a second convey path portion;

there is provided an escape portion for temporarily escaping the processed medium conveyed in said first convey path portion and for conveying the processed medium to said second convey path portion with a tail end of the processed medium facing forwardly is provided between said first and second convey path portions; and a conveying means which does not apply any load to the processed medium when the processed medium is being conveyed by said conveying system of said first processing portion, and which starts to applying a conveying force to the processed medium after conveyance of the processed medium effected by said conveying system of said first processing portion is finished.

2. A conveying apparatus according to claim 1, wherein said conveying means is provided at said escape portion.

3. A conveying apparatus according to claim 1 or 2, wherein said convey path is bent at said escape portion.

4. A conveying apparatus according to claim 1 or 2, wherein said conveying means comprises a roller shiftable in an up-and-down direction.

5. A conveying apparatus according to claim 1 or 2, wherein said conveying means comprises a D-cut roller.

6. A conveying apparatus according to claim 1 or 2, further comprising a shutter for directing the tail end of the processed medium conveyed from said first convey path portion to said second convey path portion.

7. A conveying apparatus according to one of claims 1 to 2, wherein:

said conveying means includes a vertically shiftable roller provided in said first convey path portion, and a D-cut roller provided at said escape portion;

said first convey path portion includes a first processed medium detecting means and a second processed medium detecting means; and said second convey path portion includes convey rollers;

wherein the above elements are disposed to satisfy a relation "$L3<L1<L2<L$", when assuming a length of an arc of said D-cut roller L, a distance from a nip point of said vertically shiftable roller to said D-cut roller L1, a distance from said first processed medium detecting means to said D-cut roller L2, and a distance from said D-cut roller to most upstream convey roller among said convey rollers L3;

and wherein said second processed medium detecting means is disposed immediately in front of said escape portion.

8. A conveying apparatus according to one of claims 1 to 2, wherein the processed medium is a sheet and said first processing portion is an image forming means.

9. A conveying apparatus according to one of claims 1 to 2, wherein the processed medium is a sheet and said second processing portion is a fixing means.

10. A sheet conveying apparatus according to claim 9, wherein at least one roller having a driving force is disposed in said second convey path portion between said escape portion and said fixing means, and said roller is a one-way roller driven by a conveying force of said fixing means not to generate slip between the sheet surface and said roller.

11. A sheet conveying apparatus according to claim 10, wherein a plurality of said rollers are provided, and, by a conveying force of a most downstream roller among said rollers contacted with the sheet, the other upstream rollers are rotatingly driven.

12. A sheet conveying apparatus according to claim 10, wherein a temperature of a surface of the sheet is increased before the fixing by applying fixing heat generated by said fixing means to said second convey path portion.

13. An image forming apparatus comprising:

a sheet conveying apparatus according to claim 12;

an image forming means as said first processing portion; and a fixing means as said second processing portion.

14. An image forming apparatus according to claim 13, wherein an image is formed on a sheet obtained by coating ink permeable polymer film on a substrate wherein, after the image is formed on the sheet by said image forming means in an ink jet manner, the sheet is thermally treated by said fixing means to make said polymer film finer.

15. A recording apparatus which includes a first processing portion for processing a sheet while conveying the sheet and a second processing portion for processing the sheet while conveying the sheet processed by said first processing portion comprising:

convey means for conveying the sheet processed by said first processing portion in a first predetermined direction and for conveying the sheet in a second direction opposite to said first direction after a tail end of the sheet passes through said first processing portion; and guide means for guiding the sheet conveyed by said convey means in said second direction to said second processing portion, wherein said first processing portion includes an image forming means for forming an image on the sheet, and wherein said second processing portion includes a heating means for fixing the image formed by said image forming means to the sheet by heating the sheet.

16. A recording apparatus according to claim 15, further comprising a guide for guiding the sheet being conveyed by said convey means, and a sheet having a length greater than a predetermined length exceeds said guide and is suspended from said guide when the sheet is conveyed by said convey means in said first direction.

17. A recording apparatus according to claim 15, wherein said first and second processing portions are disposed in an up-and-down relation.

18. A recording apparatus according to claim 15, wherein said convey means does not pinch the sheet when the sheet is being processed by said first processing portion and pinches the sheet after the processing of the sheet effected by said first processing portion is finished.

19. A recording apparatus according to claim 18, wherein said convey means comprises a pair of convey rollers separable away from each other.

20. A recording apparatus according to claim 19, wherein one of said pair of convey rollers has a portion having a radius smaller than that of a remaining peripheral portion.

21. A recording apparatus according to claim 15, wherein said first processing portion effects the processing regarding a continuous sheet wound in a roll form.

22. A recording apparatus according to claim 21, further comprising a cutter disposed between said first processing portions and said convey means.

23. A recording apparatus according to claim 15, wherein said image forming means forms the image by discharging ink.

24. A recording apparatus according to claim 23, further comprising a carriage for shifting said image forming means in a width-wise direction of the sheet, and said image forming means forms an image having a predetermined length in a sheet conveying direction while being shifted in the width-wise direction of the sheet.

25. A recording apparatus according to claim 24, wherein said first processing portion includes a second convey means conveying the sheet by the predetermined length and then is stopped whenever said image forming means forms the image having the predetermined length in the sheet conveying direction.

26. A recording apparatus according to one of claims 23 to 25, wherein the sheet is obtained by coating ink permeable polymer film on a substrate.

27. A recording apparatus according to claim 26, wherein said second processing portion includes a heating means for changing said ink permeable polymer film to a transparent coating film by heating the sheet.

28. A recording apparatus according to claim 27, wherein the sheet is conveyed at a predetermined constant speed in said second processing portion.

29. A recording apparatus according to claim 15, wherein said first processing portion and said second processing portion are disposed so that sheet convey path therefore are contiguous with each other.

30. A recording apparatus comprising a first processing portion, a second processing portion and a conveying apparatus disposed between the first processing portion and the second processing portion each processing portion having an independent conveying system, and the conveying apparatus including a convey path for feeding a processed medium conveyed from said first processing portion to said second processing portion, wherein said convey path is divided into a first convey path portion and a second convey path portion;

wherein there is provided an escape portion for temporarily escaping the processed medium conveyed in said first convey path portion and for conveying the processed medium to said second convey path portion with a tail end of the processed medium facing forwardly is provided between said first and second convey path portions; and a conveying means which does not apply any load to the processed medium when the processed medium is being conveyed by said conveying system of said first processing portion, and which starts to applying a conveying force to the processed medium after conveyance of the processed medium effected by said conveying system of said first processing portion is finished.

31. A recording apparatus according to claim 30, wherein said conveying means is provided at said escape portion.

32. A recording apparatus according to claim 30 or 31, wherein said convey path is bent at said escape portion.

33. A recording apparatus according to claim 30 or 31, wherein said conveying means comprises a roller shiftable in an up-and-down direction.

34. A recording apparatus according to claim 30 or 31, wherein said conveying means comprises a D-cut roller.

35. A recording apparatus according to claim 30 or 31, further comprising a shutter for directing the tail end of the processed medium conveyed from said first convey path portion to said second convey path portion.

36. A recording apparatus according to claims 30 or 31, wherein:

said conveying means includes a vertically shiftable roller provided in said first convey path portion, and a D-cut roller provided at said escape portion;

said first convey path portion includes a first processed medium detecting means and a second processed medium detecting means; and said second convey path portion includes convey rollers;

wherein the above elements are disposed to satisfy a relation "$L3<L1<L2<L$", when assuming a length of an arc of said D-cut roller L, a distance from a nip point of said vertically shiftable roller to said D-cut roller L1, a distance from said first processed medium detecting means to said D-cut roller L2, and a distance from said D-cut roller to most upstream convey roller among said convey rollers L3;

and wherein said second processed medium detecting means is disposed immediately in front of said escape portion.

37. A recording apparatus according to one of claims 30 or 31, wherein the processed medium is a sheet and said first processing portion is an image forming means.

38. A recording apparatus according to one of claims 30 or 31, wherein the processed medium is a sheet and said second processing portion is a fixing means.

39. A recording apparatus according to claim 38, wherein at least one roller having a driving force is disposed in said second convey path portion between said escape portion and said fixing means, and said roller is a one-way roller driven by a conveying force of said fixing means not to generate slip between the sheet surface and said roller.

40. A recording apparatus according to claim 35, wherein a plurality of said rollers are provided, and, by a conveying force of a most downstream roller among said rollers contacted with the sheet, the other upstream rollers are rotatingly driven.

41. A recording apparatus according to claim 35, wherein a temperature of a surface of the sheet is increased before the fixing by applying fixing heat generated by said fixing means to said second convey path portion.

42. A recording apparatus according to claim 30, wherein said first processing portion is image forming means and said second processing portion is fixing means.

43. A recording apparatus according to claim 42, wherein an image is formed on a sheet obtained by coating ink permeable polymer film on a substrate wherein, after the image is formed on the sheet by said image forming means in an ink jet manner, the sheet is thermally treated by said fixing means to make said polymer film finer.

* * * * *

UNITED STATES PATENT AND TRADEMARK OFFICE

CERTIFICATE OF CORRECTION

PATENT NO. : 6,341,861 B1
DATED : January 29, 2002
INVENTOR(S) : Norio Sasaki

It is certified that error appears in the above-identified patent and that said Letters Patent is hereby corrected as shown below:

Title page,
Item [57], ABSTRACT,
Line 8, "nip" should read -- a nip --.

Column 2,
Line 48, "an" should read -- the --.

Column 5,
Line 51, "same" should read -- the same --.

Column 6,
Line 39, "synchronous" should read -- synchronism --.

Column 8,
Line 10, "to rotate" (2nd occurrence) should be deleted.
Line 28, "greater" should read -- a greater --.

Column 9,
Line 63, "applying" should read -- apply --.

Column 12,
Line 23, "applying" should read -- apply --.

Column 13,
Line 7, "claim 35," should read -- claim 39, --.
Line 12, "claim 35," should read -- claim 39 or 40, --.

Signed and Sealed this

Eleventh Day of June, 2002

*Attest:*

*Attesting Officer*

JAMES E. ROGAN
*Director of the United States Patent and Trademark Office*